US006565275B2

(12) United States Patent
Brand et al.

(10) Patent No.: US 6,565,275 B2
(45) Date of Patent: May 20, 2003

(54) MARKER WITH ERASER

(75) Inventors: Douglas A. Brand, Easton, PA (US); Vito Niosi, Easton, PA (US); Robert S. Volk, Easton, PA (US)

(73) Assignee: Binney & Smith Inc., Easton, PA (US)

( * ) Notice: Subject to any disclaimer, the term of this patent is extended or adjusted under 35 U.S.C. 154(b) by 0 days.

(21) Appl. No.: 09/843,524

(22) Filed: Apr. 27, 2001

(65) Prior Publication Data

US 2002/0159817 A1 Oct. 31, 2002

(51) Int. Cl.[7] ..... B43K 25/00

(52) U.S. Cl. ..... 401/52; 401/195; 15/428; 15/425

(58) Field of Search ..... 401/52, 195, 88, 401/89; 15/424–434; D19/53, 36

(56) References Cited

U.S. PATENT DOCUMENTS

| | | | | | |
|---|---|---|---|---|---|
| 85,961 | A | * | 1/1869 | Reckendorfer | 15/431 |
| 126,224 | A | * | 4/1872 | Muller | 15/431 |
| 144,337 | A | | 11/1873 | Illfelder | |
| 384,383 | A | | 6/1888 | Myers | |
| 426,950 | A | | 4/1890 | Negraval | |
| 1,352,677 | A | * | 9/1920 | Moore | 401/52 |
| 1,513,439 | A | | 10/1924 | Wickers | |
| 1,750,912 | A | | 3/1930 | Towne | |
| 1,985,307 | A | | 12/1934 | Boast | |
| 2,148,684 | A | * | 2/1939 | Chesler | 15/427 |
| 2,180,132 | A | | 11/1939 | Zoll | |
| 2,283,107 | A | * | 5/1942 | Van Dorn | 401/202 |
| 2,341,717 | A | * | 2/1944 | Hoffmann | 401/52 |
| 2,785,100 | A | | 3/1957 | Yaw | |
| 3,262,425 | A | * | 7/1966 | Waugh | 15/431 |
| 3,704,071 | A | | 11/1972 | Muller et al. | |
| 4,557,618 | A | * | 12/1985 | Iwata et al. | 401/34 |
| 4,856,693 | A | | 8/1989 | Kageyama et al. | |
| 4,991,985 | A | | 2/1991 | Laipply | |
| 5,022,774 | A | | 6/1991 | Kageyama et al. | |
| 5,072,483 | A | | 12/1991 | Durand | |
| 5,236,270 | A | | 8/1993 | Kageyama et al. | |
| 5,356,232 | A | | 10/1994 | Skinner | |
| 5,432,973 | A | | 7/1995 | Wagner et al. | |
| 5,774,931 | A | | 7/1998 | Coinon et al. | |
| 5,855,442 | A | | 1/1999 | Keller | |
| 5,871,294 | A | | 2/1999 | Turner | |
| 5,897,266 | A | * | 4/1999 | Robert | 401/202 |
| 5,957,603 | A | | 9/1999 | Bell | |
| 6,004,057 | A | | 12/1999 | Fulop | |
| 6,019,535 | A | | 2/2000 | Turner | |
| 6,048,121 | A | | 4/2000 | Carver | |
| 6,056,468 | A | | 5/2000 | Niewiadomski | |
| 6,290,413 | B1 | | 9/2001 | Wang | |

FOREIGN PATENT DOCUMENTS

| | | | |
|---|---|---|---|
| DE | 30 48 899 A | | 7/1982 |
| FR | 1017665 | | 12/1952 |
| JP | 8-332798 | * | 6/1995 |

* cited by examiner

*Primary Examiner*—Gregory L. Huson
*Assistant Examiner*—Huyen Le
(74) *Attorney, Agent, or Firm*—Leydig, Voit & Mayer, Ltd.

(57) ABSTRACT

The marker may include a body, a cap, an end plug and an eraser. In one of the embodiments, the eraser is molded onto the end plug. The end plug may include an attachment portion and the eraser may have an attachment portion. The attachment portion on the end plug corresponds to the attachment portion on the eraser. The attachment portions may have different shapes and/or cross sections. In other embodiments the eraser may be attached to the end of the marker, to the barrel, or to the cap.

26 Claims, 11 Drawing Sheets

MARKER WITH ERASER

FIELD OF THE INVENTION

This invention relates generally to the field of writing instruments with erasers, and more particularly to markers with erasers.

BACKGROUND OF THE INVENTION

Children and adults use markers to write and to make drawings. One of the difficulties with markers is that the mark cannot be erased from paper. If the user makes a mistake using the marker, the user is not able to remove the mark from the paper. Therefore, there is a need for a marker which can be erased from paper.

Furthermore, if the user was provided with an erasable marker, the user would also need an eraser to erase any unwanted markings from the paper. A separately provided eraser could become lost or misplaced when the user wishes to use the erasable marker. Consequently, the user would not be able to erase the unwanted marks on the paper. Therefore, there is a need for an erasable marker which includes an eraser.

The invention provides such a device. These and other advantages of the present invention, as well as other inventive features, will be apparent from the description of the invention provided herein.

SUMMARY OF THE INVENTION

The marker may include a body, a cap, an end plug and an eraser 108. In one of the embodiments, the eraser is molded onto the end plug. The end plug may include an attachment portion and the eraser may have an attachment portion. The attachment portion on the end plug corresponds to the attachment portion on the eraser. The attachment portions may have different shapes and/or cross sections. In other embodiments the eraser may be attached to the end of the marker, to the barrel, or to the cap.

Other advantages of the invention will become apparent upon reading the following detailed description and upon reference to the drawings.

DESCRIPTION OF THE INVENTION

Figure 1:
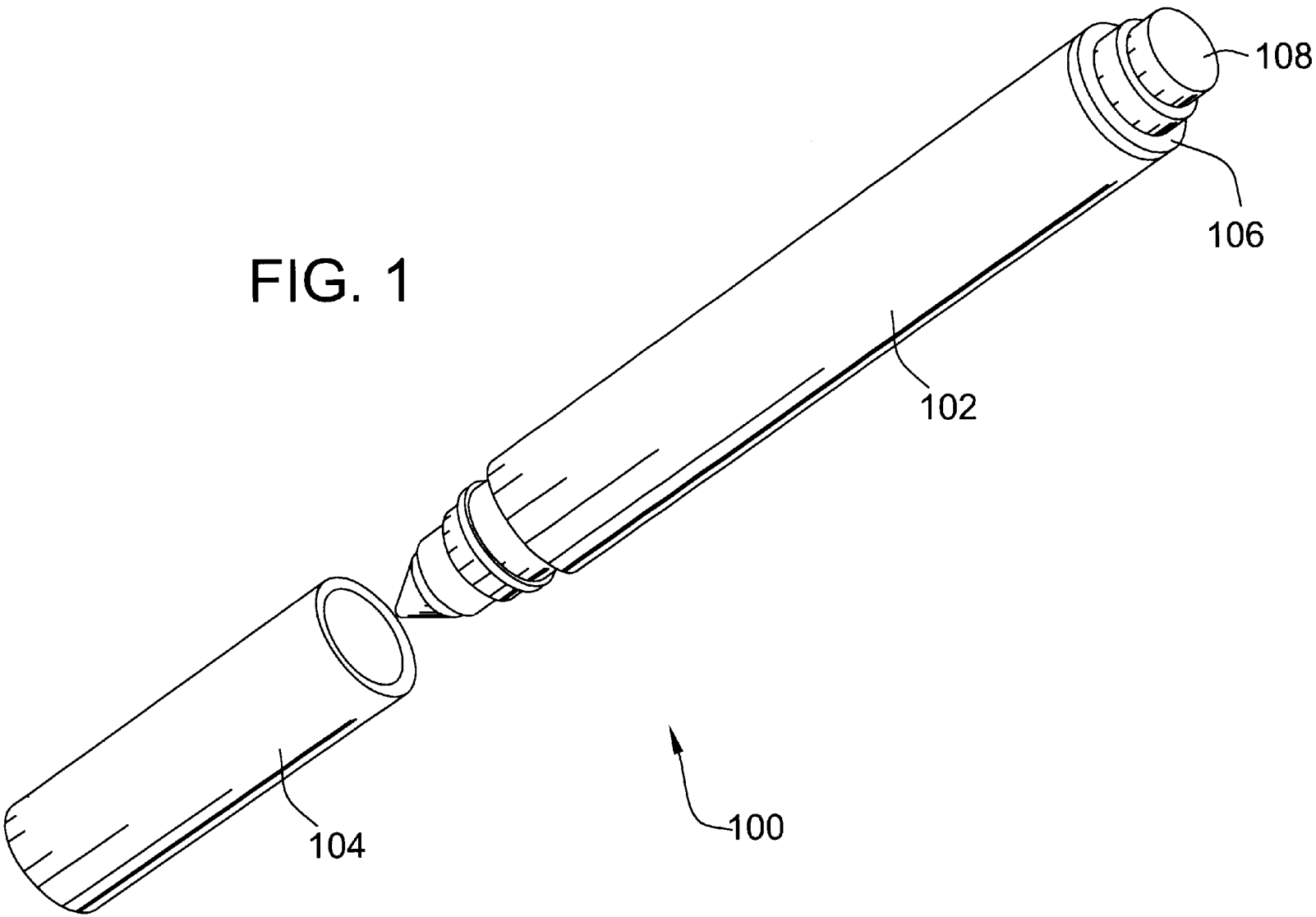
FIG. 1 is a perspective view of the marker with an eraser according to an embodiment of the present invention.

A marker constructed in accordance with the teachings of the invention is illustrated in FIG. 1. The marker 100 may include a body 102, a cap 104, an end plug 106 and an eraser 108.

Figure 3:
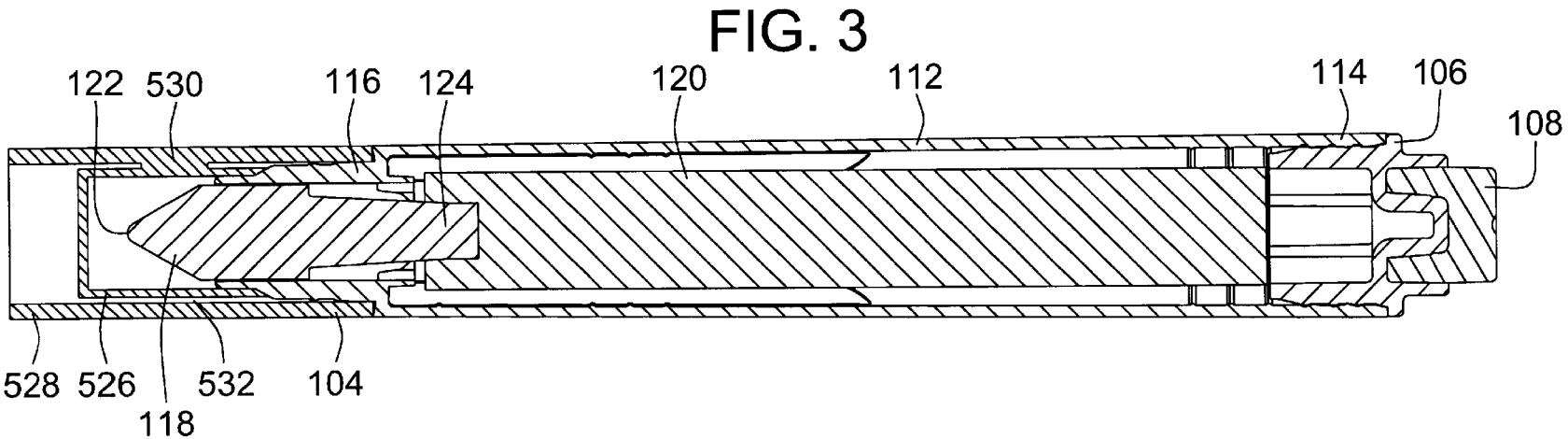
FIG. 3 is a cross-sectional view of the marker taken along line 3—3 in FIG. 2.
Figure 2:
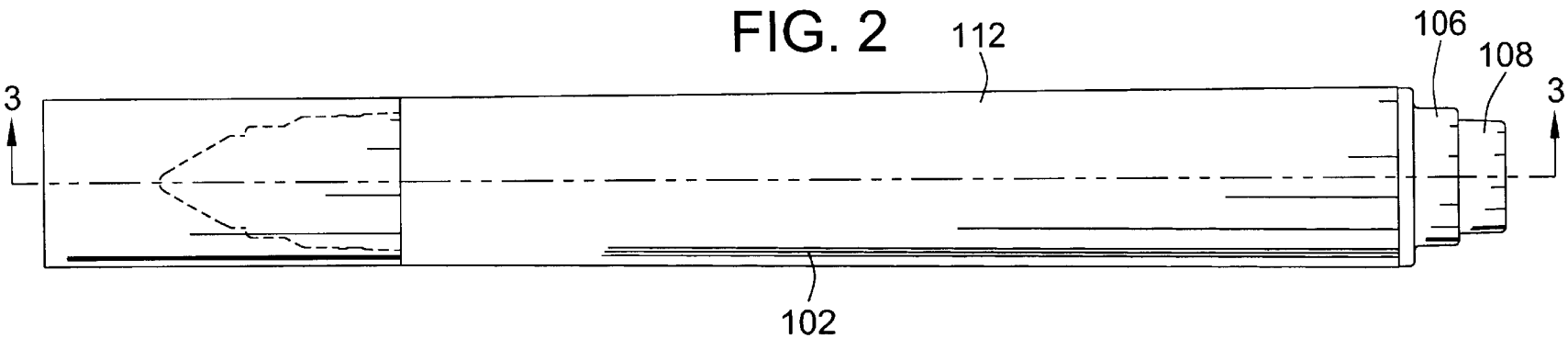
FIG. 2 is a front view of the marker in FIG. 1.

Referring to FIGS. 2 and 3, the body 102 may include a barrel 112 which may have an open end 114 and a drawing end 116. The drawing end 116 receives a nib 118, and the open end 114 receives an ink reservoir 120. The nib 118 further includes a writing end 122 and a contacting end 124 that engages the reservoir 120. The reservoir 120 may include an element which contains the ink. In another embodiment, the reservoir allows the ink to move within the reservoir and such systems are sometimes referred to as "free ink systems". The ink flows from the reservoir 120 through the nib 118 when the writing end 122 contacts a writing surface.

Figure 4:
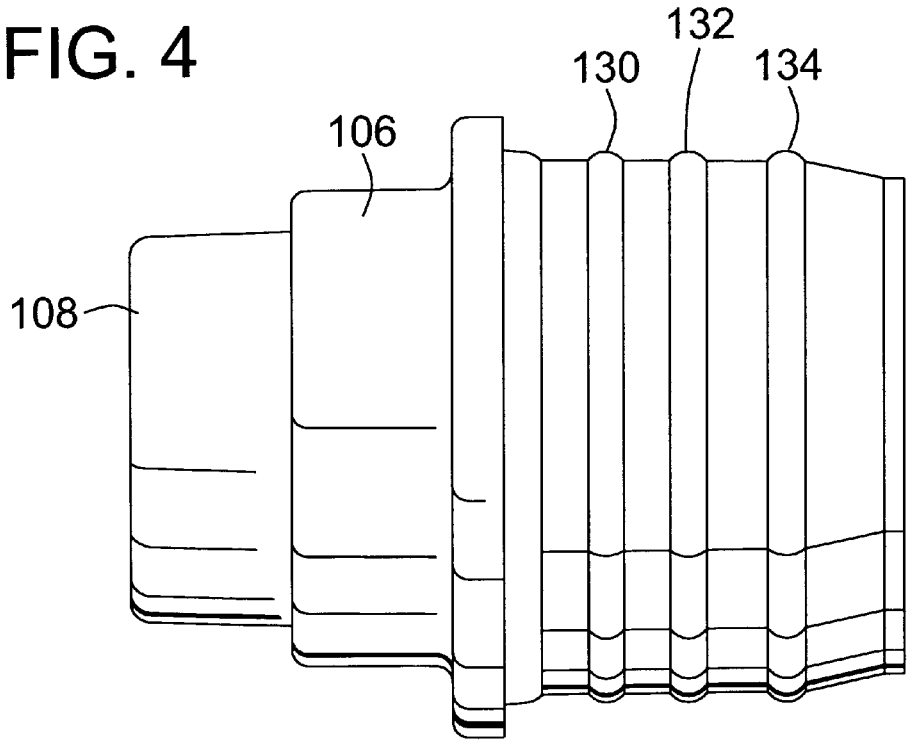
FIG. 4 is a front view of the end plug and eraser for the marker in FIG. 2.
Figure 5:
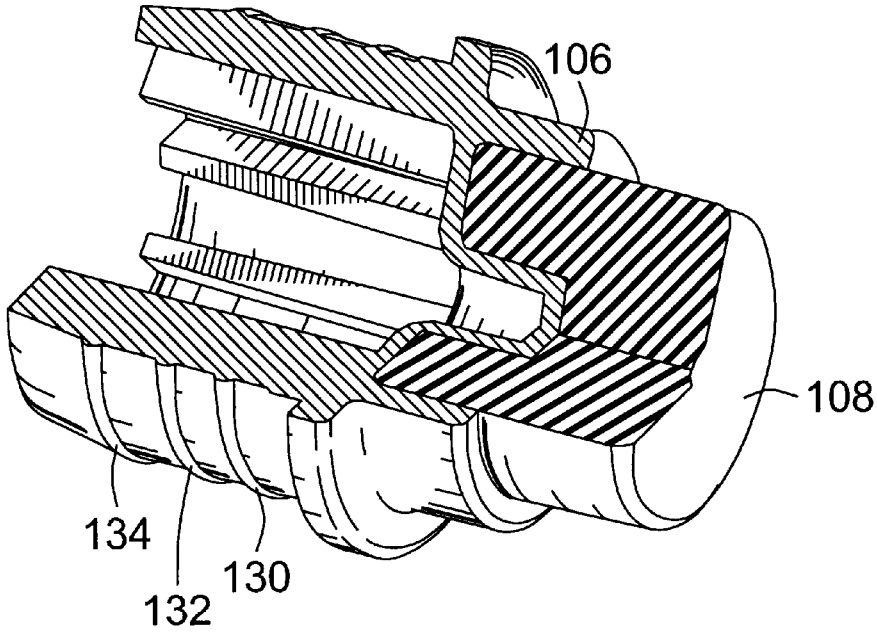
FIG. 5 is a perspective view of the end plug and eraser with a portion of the end plug and eraser broken away.
Figure 9:
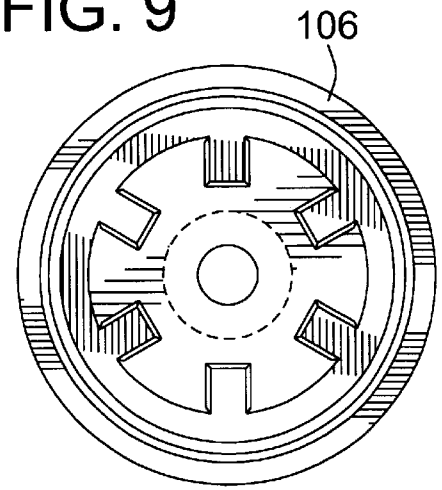
FIG. 9 is a bottom view of the end plug taken along line 9—9 FIG. 6.
Figure 6:
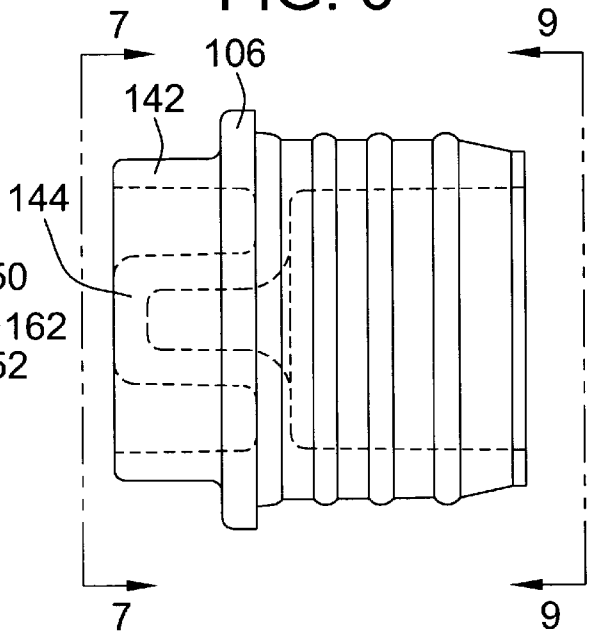
FIG. 6 is a front view of the end plug.
Figure 8:
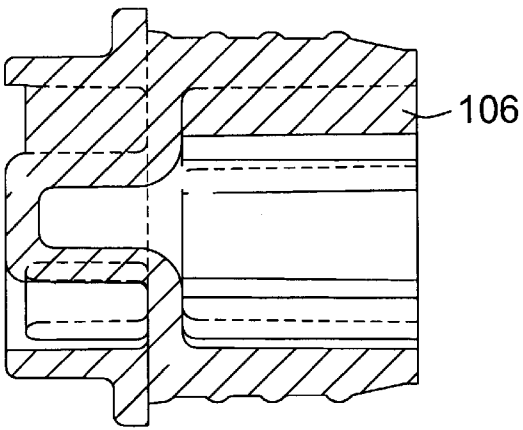
FIG. 8 is a cross-sectional view taken along line 8—8 in FIG. 7.
Figure 7:
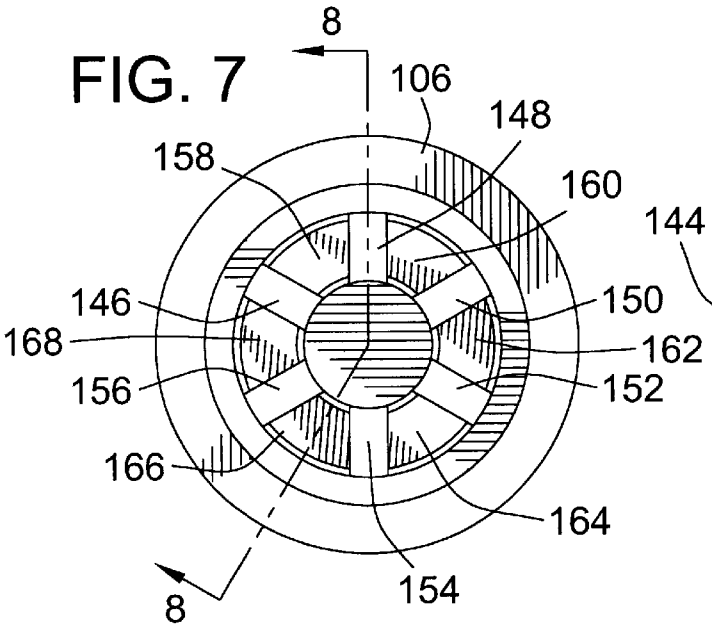
FIG. 7 is a top view of the end plug taken along line 7—7 in FIG. 6.
Figure 11:
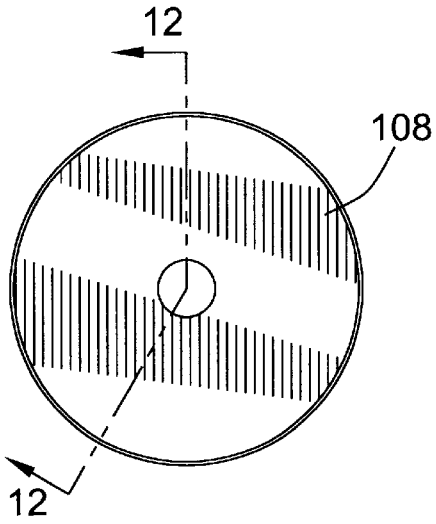
FIG. 11 is a top view of the eraser taken along line 11—11 in FIG. 10.
Figure 10:
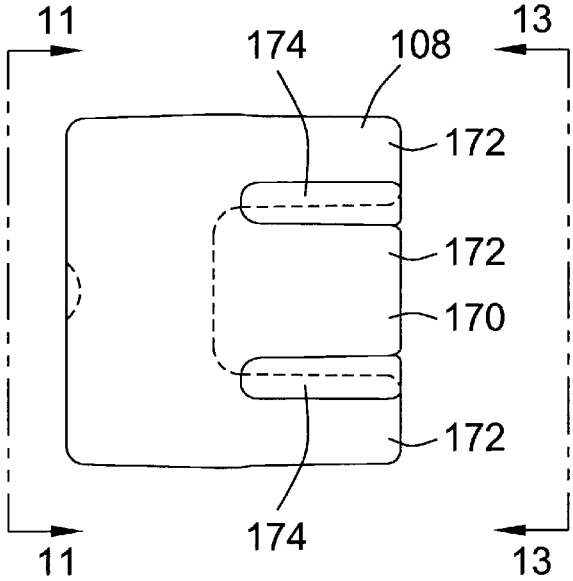
FIG. 10 is a front view of the eraser shown in FIG. 4.
Figure 13:
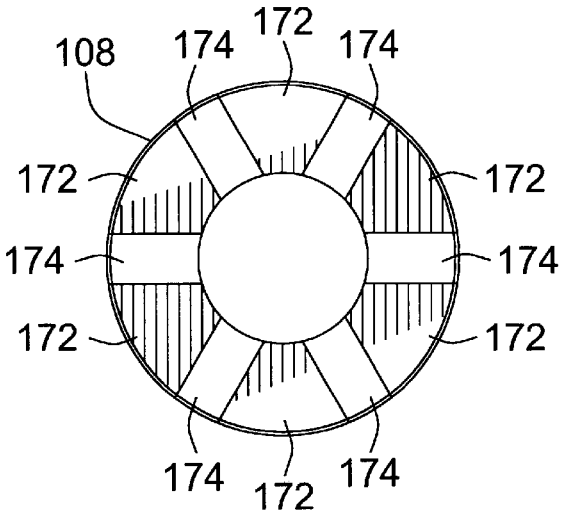
FIG. 13 is a bottom view of the eraser taken along line 13—13 in FIG. 10.
Figure 12:
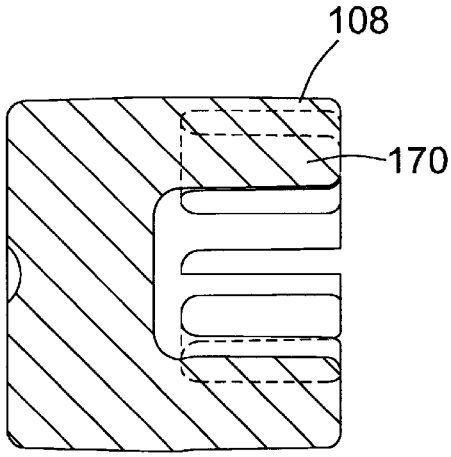
FIG. 12 is a cross-sectional view of the eraser taken along line 12—12 in FIG. 11.

In this embodiment, the end plug 106 is received within the open end 114 of the barrel 112. The end plug 106 seals the open end 114 of the barrel which contains the ink reservoir 120. Referring to FIGS. 4 and 5, the end plug 106 includes annular ridges 130, 132, 134 that engage the interior of the open end 114, to secure and seal the end plug 106 within the barrel 112 as shown in FIG. 3. The marker body 102 is thus sealed, to prevent ink in the reservoir from evaporating.

Referring to FIGS. 2 and 3, the eraser 108 is attached to the end plug 106. The eraser 108 may be molded to the end plug as will be discussed in a later section herein. Referring to FIGS. 6, 7, 8 and 9, the end plug 106 includes an attachment portion 140. The attachment portion 140 may include an outer wall 142, a post 144 and ribs 146, 148, 150, 152, 154, 156. Recesses 158, 160, 162, 164, 166, 168 are located between the ribs 146, 148, 150, 152, 154, 156. In other embodiments, the attachment portion may include one, two, three, four, five, seven, eight or more ribs. In another embodiment, the attachment portion may only include the outer wall 142 and the post 144 and would not include the ribs. In another embodiment, the attachment portion may only include the outer wall 142 and not include the post or ribs. In another embodiment, the attachment portion may only include the post 144 and not include the wall or ribs. In yet another embodiment, the attachment portion may include the post 144 with one or more ribs 146 and not include the outer wall 142.

Referring to FIGS. 10, 11, 12 and 13, the eraser 108 includes an attachment portion 170. The attachment portion 170 may have a shape which corresponds to the attachment portion 140 on the end plug. In this embodiment, the attachment portion 170 has six protrusions 172 which correspond to the recesses 158–168 on the attachment portion of the end plug and six recesses 174 which correspond to the ribs 146–156 on the attachment portion of the end plug. In other embodiments, the attachment portion 170 would correspond to other embodiments of the attachment portion for the end plug. For example, if the attachment portion of the end plug only had a wall 142, then the attachment portion 170 of the eraser could be solid and would not need the protrusions 172. In another example, if the attachment portion 140 of the end plug only had a post 144, then the attachment portion of the eraser would only need a recess to accommodate the post.

Figure 14:
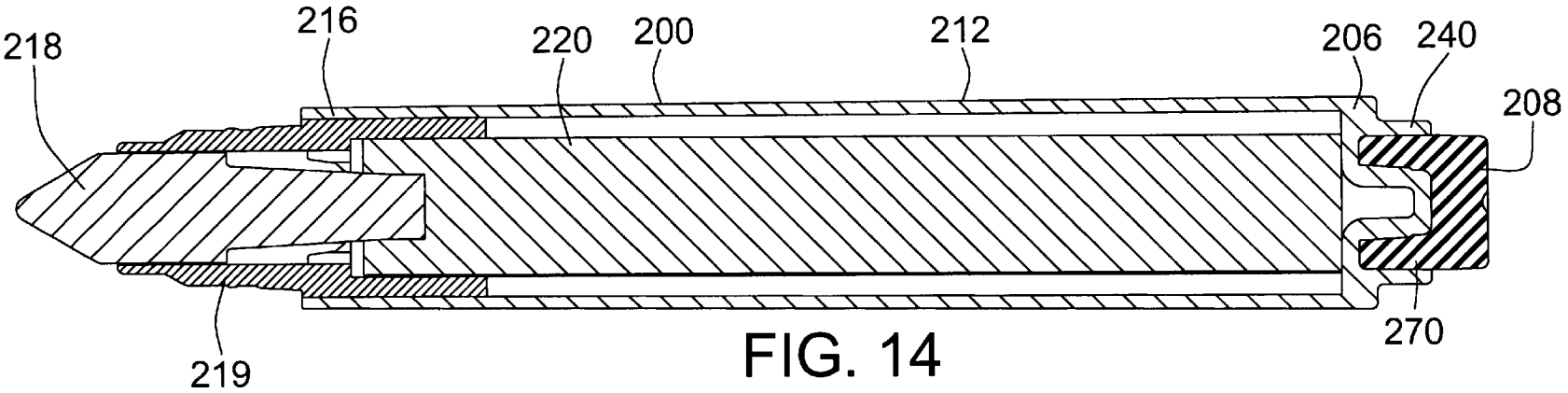
FIG. 14 is a front view of another embodiment of a marker.

Referring to FIG. 14, another embodiment of the marker is shown. In this embodiment, the marker does not include a separate end plug. The end 206 is molded as part of the barrel 212. The attachment portion 240 on the end 206 and the attachment portion 270 on the eraser 208 may be similar to the embodiments noted above. In this embodiment, the reservoir 220 would be inserted from the drawing end 216 of the barrel. The nib 218 and the collet 219 would then be attached to the barrel 212.

Figure 15:
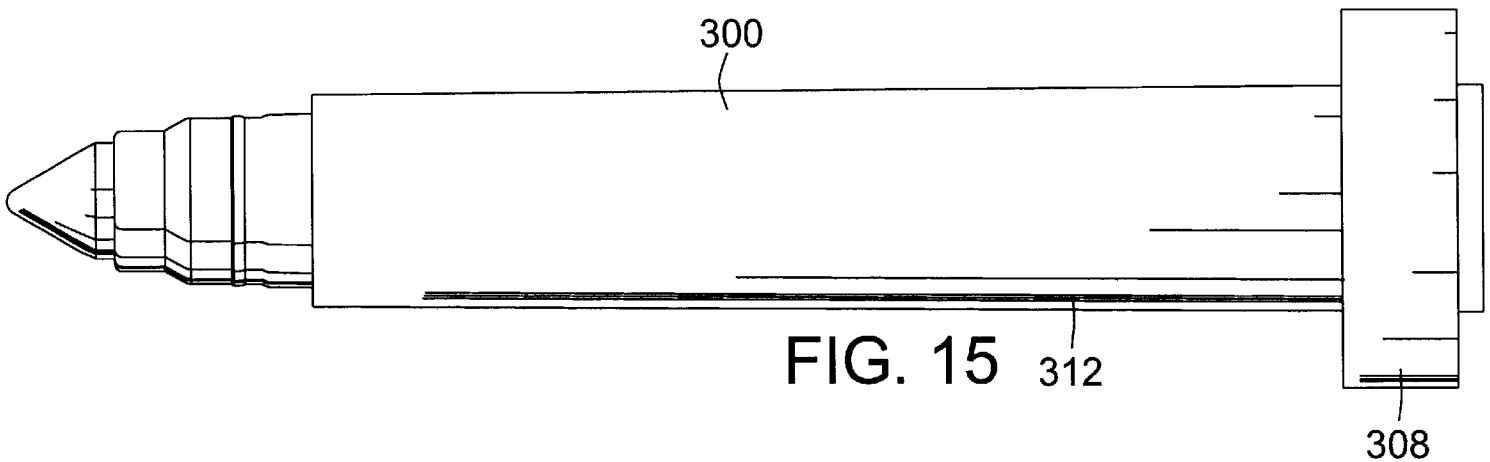
FIG. 15 is a front view of another embodiment of a marker.

Referring to FIG. 15, another embodiment of the marker is shown. The marker 300 includes an eraser 308 which is attached to the barrel 312. In other respects, the marker 300 may be similar to the other embodiments noted above. In another embodiment, the eraser 308 could be attached to the outside surface of the end plug.

Figure 16:
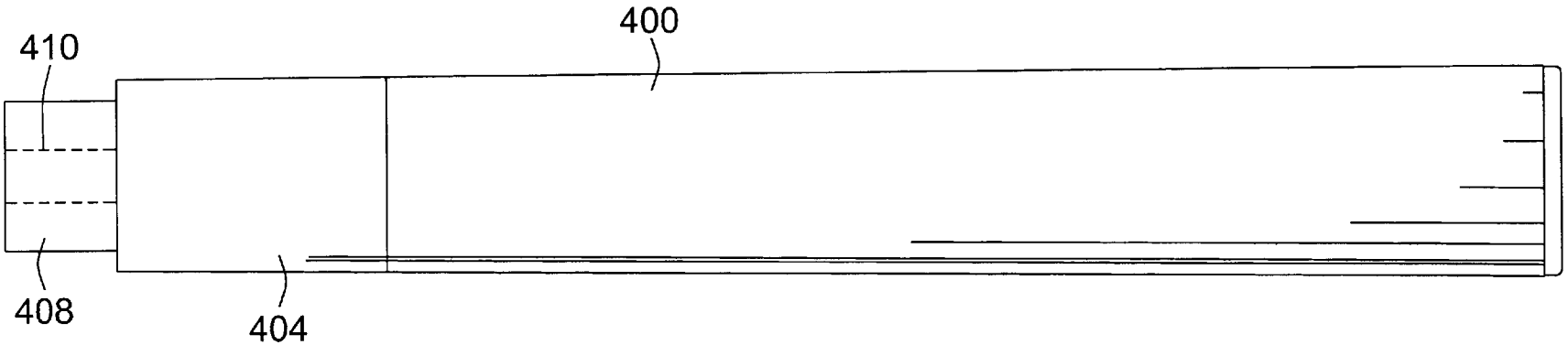
FIG. 16 is a front view of another embodiment of a marker.
Figure 20:
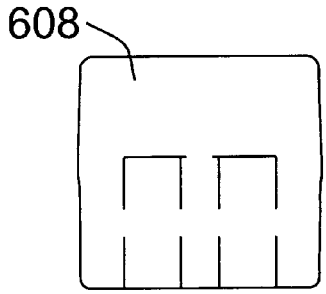
FIG. 20 is a side view of the eraser in FIG. 19.
Figure 19:
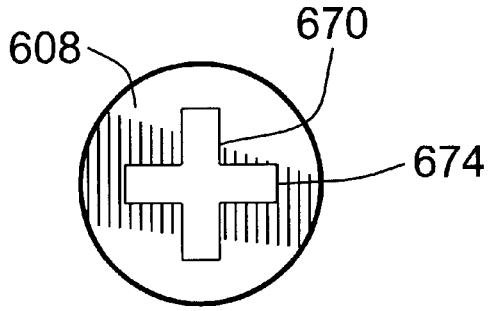
FIG. 19 is a bottom view of another embodiment of an eraser.
Figure 17:
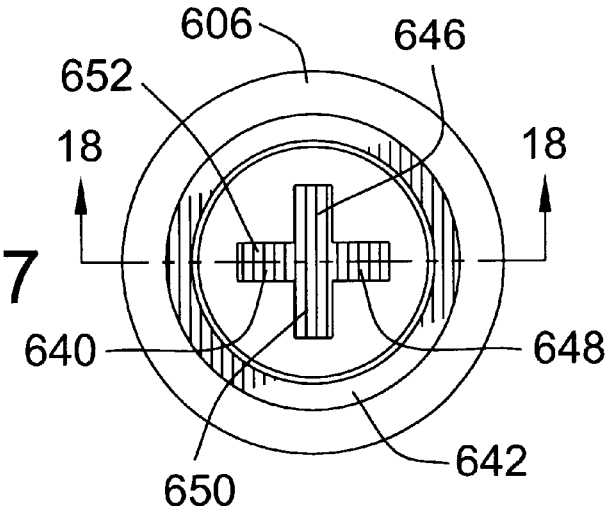
FIG. 17 is a top view of another embodiment of an end plug.
Figure 18:
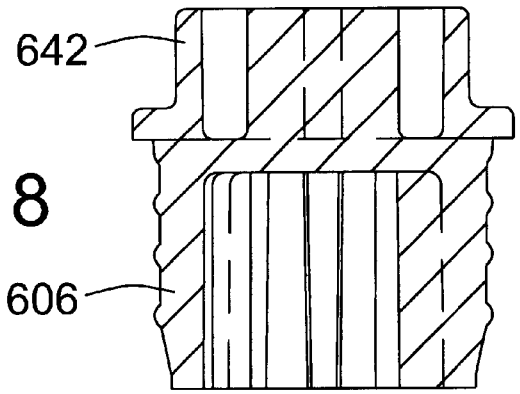
FIG. 18 is a cross-sectional view taken along line 18—18 in FIG. 17.
Figure 24:
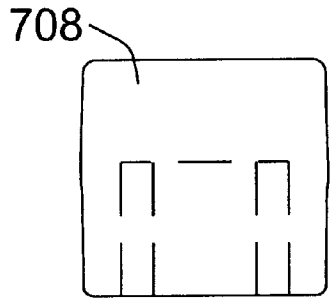
FIG. 24 is a side view of the eraser in FIG. 23.
Figure 23:
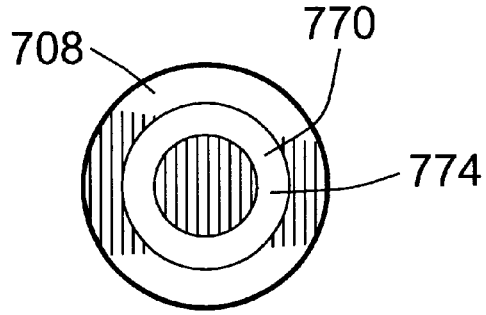
FIG. 23 is a bottom view of another embodiment of an eraser.
Figure 21:
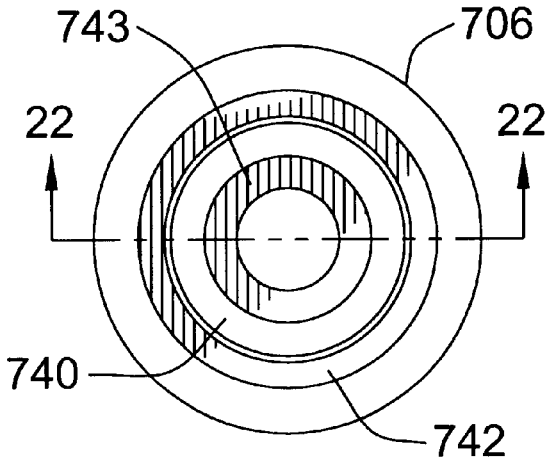
FIG. 21 is a top view of another embodiment of an end plug.
Figure 22:
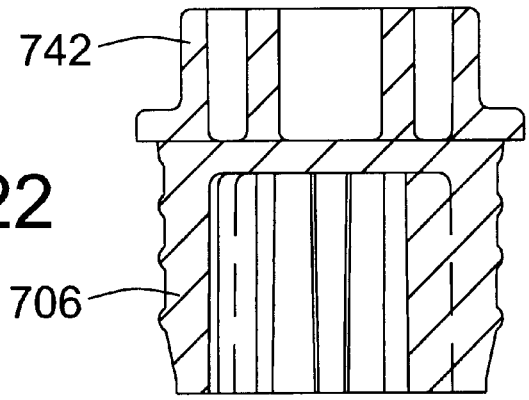
FIG. 22 is a cross-sectional view taken along line 22—22 in FIG. 21.
Figure 28:
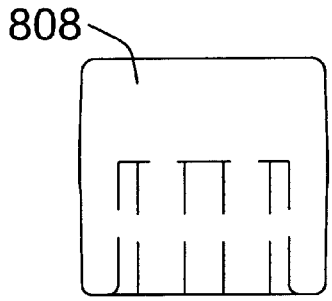
FIG. 28 is a side view of the eraser in FIG. 27.
Figure 27:
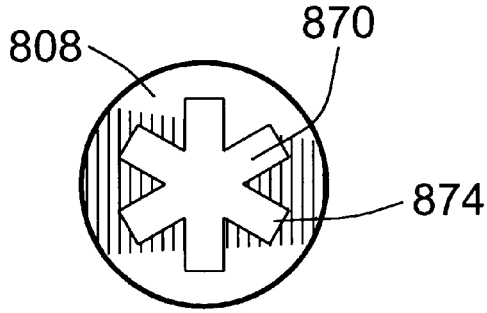
FIG. 27 is a bottom view of another embodiment of an eraser.
Figure 25:
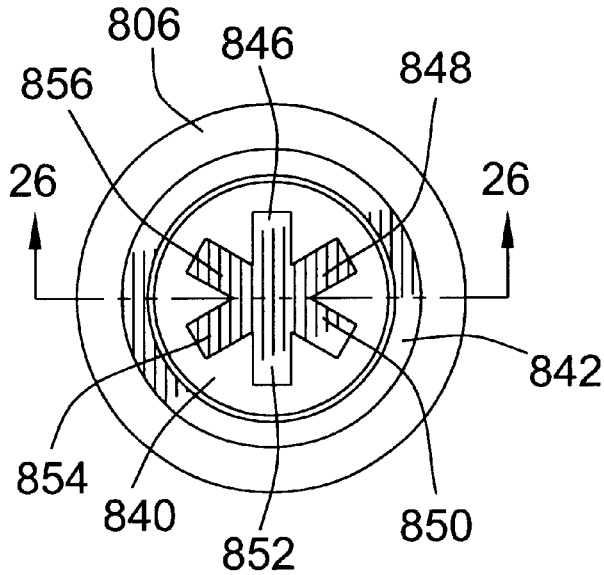
FIG. 25 is a top view of another embodiment of an end plug.
Figure 26:
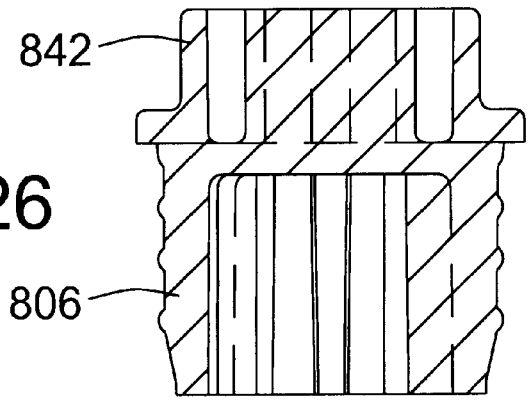
FIG. 26 is a cross-sectional view taken along line 26—26 in FIG. 25.
Figure 32:
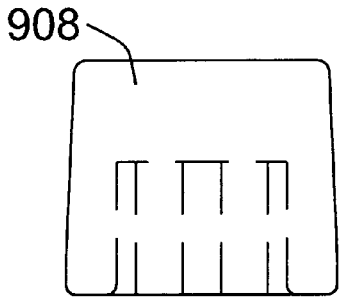
FIG. 32 is a side view of the eraser in FIG. 31.
Figure 31:
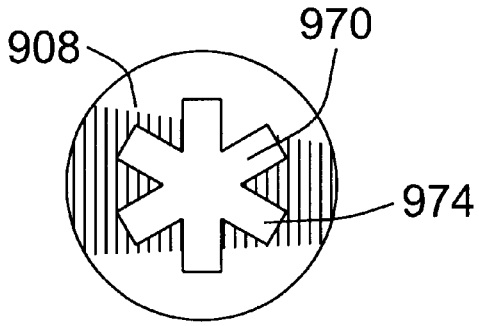
FIG. 31 is a bottom view of another embodiment of an eraser.
Figure 29:
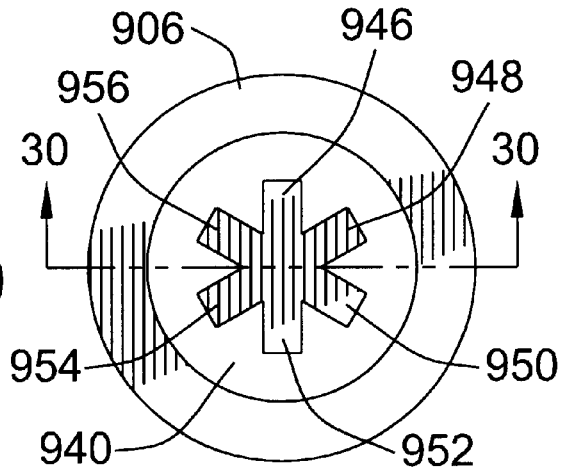
FIG. 29 is a top view of another embodiment of an end plug.
Figure 30:
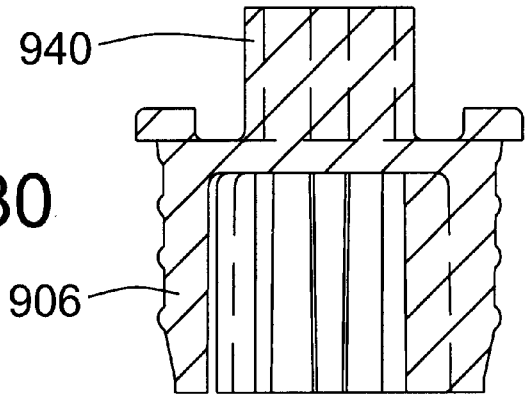
FIG. 30 is a cross-sectional view taken along line 30—30 in FIG. 29.

Referring to FIG. 16, another embodiment of the marker is shown. The marker 400 includes an eraser 408 which is attached to the cap 404. The attachment portion on the cap 404 and the attachment portion on the eraser 408 may be similar to the embodiments noted above. In other respects, the marker 400 may be similar to the other embodiments noted above. The eraser 408 may include an opening 410 which permits the cap to be a ventilated cap which will be described below.

One embodiment of a ventilated cap is shown in FIG. 3. The cap 104 includes an inner cap 526, an outer cap 528 and connecting portions 530. The cap 104 is vented to reduce its potential choking hazard to children. If the vented cap 104 were to lodge in a child's throat, it would allow the child to breath until removed. The venting may be achieved by the use of a ventilation passage 532. The passage 532 is the space between the inner cap 526 and the outer cap 528, resulting from the connecting in a coaxial, spaced apart relationship by connecting portions 530. Therefore, when the ventilated cap is used with the eraser 408 shown in FIG. 15, an air passage is permitted through opening 410 in order to provide a ventilated cap. In another embodiment, the ventilation passage could be maintained by creating ventilation passage or passages around the perimeter of the eraser 408.

Another embodiment of the attachment portion for the end plug and the attachment portion for the eraser is shown in FIGS. 17–20. The end plug 606 includes an attachment portion 640. The attachment portion 640 may include an outer wall 642 and ribs 646, 648, 650, 652. The eraser 608 includes an attachment portion 670. The attachment portion 670 may have a shape which corresponds to the attachment portion 640 on the end plug. The attachment portion 670 may include a recess 674.

Another embodiment of the attachment portion for the end plug and the attachment portion for the eraser is shown in FIGS. 21–24. The end plug 706 includes an attachment portion 740. The attachment portion 740 may include an outer wall 742 and an inner wall 743. The eraser 708 includes an attachment portion 770. The attachment portion 770 may have a shape which corresponds to the attachment portion 740 on the end plug. The attachment portion 770 may include a recess 774.

Another embodiment of the attachment portion for the end plug and the attachment portion for the eraser is shown in FIGS. 25–28. The end plug 806 includes an attachment portion 840. The attachment portion 840 may include an outer wall 842 and ribs 846, 848, 850, 852, 854, 856. The eraser 808 includes an attachment portion 870. The attachment portion 870 may have a shape which corresponds to the attachment portion 840 on the end plug. The attachment portion 870 may include a recess 874.

Another embodiment of the attachment portion for the end plug and the attachment portion for the eraser is shown in FIGS. 29–32. The end plug 906 includes an attachment portion 940. The attachment portion 940 may include ribs 946, 948, 950, 952, 954, 956. The eraser 908 includes an attachment portion 970. The attachment portion 970 may have a shape which corresponds to the attachment portion 940 on the end plug. The attachment portion 970 may include a recess 974.

The eraser may be assembled to the marker in the following manner. Referring to FIG. 3, the end plug 106 and the eraser 108 are made by using a two part molding process. The end plug 106 and the eraser 108 are molded using an injection molding machine which has a two part mold. The end plug 106 is molded first as shown in FIGS. 6, 7, 8 and 9. The mold is then moved inside the injection molding machine and the eraser 108 is molded onto the end plug 106 as shown in FIGS. 3, 4, and 5. The end plug 106 and eraser 108 are then ejected from the machine.

The end plug and eraser may also be molded in the opposite sequence. For example, referring to FIG. 3, the eraser 108 could be molded first and the end plug 106 could be molded onto the eraser 108.

The other embodiments, such as FIGS. 14–32 may be molded in a similar manner.

One of the advantages of molding the eraser onto a component of the marker is that the eraser 108 is bonded to the component. In this embodiment, the eraser 108 can withstand a pulling force of 20 pounds before the eraser 108 is removed from the end plug 106.

Another advantage of molding the eraser onto a component of a marker is that an assembly step is eliminated. Specifically, another manufacturing step would be required if the eraser was separately attached to the component by an adhesive or a mechanical means. However, in other embodiments, the eraser may be connected to the marker by an adhesive, by a ferrule around the eraser and the marker, by other mechanical configurations, by fusing process, by spin welding, or by ultrasonic welding.

The end plug 106, the barrel 112 and the cap 104 are made from polyethylene. The eraser is made of a material which is capable of erasing the marks which have been made by the marker onto paper. An eraser may include one or more of the following materials: natural rubber, synthetic rubber, vinyl, gum, or silicone. One such composition for the eraser material is Krayton, Product No. G-1726 from Shell Chemical Company, P.O. Box 2463, Houston, Tex., U.S.A.

Thus, the invention provides a marker with an eraser. The invention allows a user to use the marker and then use the eraser to remove any unwanted markings from the paper. Since the eraser is connected to the marker, the possibility of losing an eraser, misplacing an eraser, or not having an eraser is eliminated.

In addition, the invention also reduces the cost of making the marker. The cost of making the marker is reduced by molding the eraser and a component of the marker in a two part molding process.

While particular embodiments of the invention have been shown, it will be understood that the invention is not limited thereto. On the contrary, the intent is to cover all alternatives, modifications and equivalents as may be included in the scope of the invention as defined by the appended claims. All references and copending applications cited herein are hereby incorporated by reference in their entireties.

What is claimed is:

1. A marker assembly comprising a marker and an eraser, the marker includes a nib and a reservoir, the nib is in fluid communication with the reservoir, the nib is porous, the nib is located at one end of the marker, the marker is capable of making marks on paper by contacting the paper with the nib, the eraser is capable of removing the marks from the paper by moving the eraser across the marks on the paper, the eraser is molded onto the other end of the marker, such that the eraser and the other end of the marker are bonded together.

2. The marker assembly as in claim 1 wherein the marker includes an end plug, the eraser is connected to the end plug.

3. The marker assembly as in claim 1 wherein the marker includes an attachment portion.

4. The marker assembly as in claim 3 wherein the attachment portion includes a post.

5. The marker assembly as in claim 4 wherein the attachment portion includes a wall.

6. The marker assembly as in claim 5 wherein the attachment portion includes a rib.

7. The marker assembly as in claim 1 wherein the eraser includes an attachment portion.

8. The marker assembly as in claim 7 wherein the attachment portion includes a recess.

9. The marker assembly as in claim 1 wherein the eraser includes a material from the group consisting of: natural rubber, synthetic rubber, vinyl, gum or silicone.

10. A method of producing a marker assembly comprising:

molding a component of a marker, the component has a first end and a second end;

molding an eraser onto the first end of the component such that the eraser and the first end of the component are bonded together, the eraser is capable of removing erasable ink marks from paper.

11. The method as in claim 10 wherein the component is an end plug.

12. The method as in claim 10 wherein the component is a barrel.

13. The method as in claim 10 wherein the component is a cap.

14. A marker assembly comprising a marker and an eraser, the marker includes a nib and a reservoir, the nib is in fluid communication with the reservoir, the nib is porous, the nib is located at one end of the marker, the marker is capable of making marks on paper by contacting the paper with the nib, the eraser is capable of removing the marks from the paper by moving the eraser across the marks on the paper, the marker includes a cap, the eraser is molded onto the cap such that the eraser and the cap are bonded together.

15. The marker assembly as in claim 14 wherein the marker includes an attachment portion.

16. The marker assembly as in claim 15 wherein the attachment portion includes a post.

17. The marker assembly as in claim 16 wherein the attachment portion includes a wall.

18. The marker assembly as in claim 17 wherein the attachment portion includes a rib.

19. The marker assembly as in claim 14 wherein the eraser includes an attachment portion.

20. The marker assembly as in claim 19 wherein the attachment portion includes a recess.

21. The marker assembly as in claim 14 wherein the eraser includes a ventilation hole.

22. The marker assembly as in claim 14 wherein the eraser includes a material from the group consisting of: natural rubber, synthetic rubber, vinyl, gum or silicone.

23. A method of producing a marker assembly comprising: molding an eraser, the eraser capable of removing erasable ink marks from paper, molding a component of a marker, the component has a first end and a second end, the first end is molded onto the eraser such that the first end and the eraser are bonded together.

24. The method as in claim 23 wherein the component is an end plug.

25. The method as in claim 23 wherein the component is a barrel.

26. The method as in claim 23 wherein the component is a cap.

* * * * *